US005738591A

United States Patent [19]

Opsal

[11] Patent Number: 5,738,591

[45] Date of Patent: Apr. 14, 1998

[54] QUEUING SYSTEM

[76] Inventor: David R. Opsal, 48 Athabaska Crescent, Saskatoon, Saskatchewan, Canada, S7K 1G8

[21] Appl. No.: 545,609

[22] PCT Filed: May 4, 1993

[86] PCT No.: PCT/CA93/00191

§ 371 Date: Jan. 16, 1996

§ 102(e) Date: Jan. 16, 1996

[87] PCT Pub. No.: WO94/25126

PCT Pub. Date: Nov. 10, 1994

[51] Int. Cl.[6] ..... A63D 15/00; A63D 15/20

[52] U.S. Cl. ..... 473/4; 473/1; 473/23

[58] Field of Search ..... 473/4, 23, 24, 473/1; 364/410

[56] References Cited

U.S. PATENT DOCUMENTS

| | | | |
|---|---|---|---|
| 4,042,491 | 8/1977 | Hazeltine et al. | 473/23 |
| 4,516,770 | 5/1985 | Brookes et al. | 473/4 |
| 5,026,053 | 6/1991 | Paterson et al. | 473/4 |
| 5,066,008 | 11/1991 | Rivera | 473/23 |
| 5,359,510 | 10/1994 | Sabaliauskas | 364/410 |

FOREIGN PATENT DOCUMENTS

| | | |
|---|---|---|
| 0 419 285 A3 | 3/1991 | European Pat. Off. . |
| 38 39 910 A1 | 5/1990 | Germany . |

*Primary Examiner*—Jessica Harrison
*Assistant Examiner*—James Schaaf
*Attorney, Agent, or Firm*—Murray E. Thrift; Adrian D. Battison

[57] ABSTRACT

A queuing system is provided for gaming apparatus such as a billiards table. The system uses a remote consol (16) that is coin operated and has a key-pad (58) for players to enter theft names in a sequence of players. The consol dispenses a ticket (76) with a unique identifier (78) marked on the ticket, corresponding to the player name. A display (18) associated with the apparatus, for example above a billiards table (12), displays the name or names of the persons playing. When a game is completed, as by pocketing the black ball in a game of snooker, the apparatus detects this condition and signals the main processor through an infrared link that the game is over. The apparatus is then locked up, as by locking a ball collector (32), until the next player enters the correct ticket at the consol to release the balls from the collector. A tournament mode of play omitting the tickets and providing for two sequences of players is also provided.

11 Claims, 4 Drawing Sheets

QUEUING SYSTEM

FIELD OF THE INVENTION

The present invention relates to game apparatus more particularly to a queuing system for use with a game apparatus.

BACKGROUND

In many establishments where gaming apparatus is installed, a queue may develop for priority of position in playing on a particular apparatus. For example, in a billiards salon, a chalk board may be provided for perspective players to enter their names in sequence. This system is not entirely reliable and it is difficult for the manager of the establishment in question to ensure that extra games are not being played at the expense of subsequent players or that where appropriate the establishment is being paid for all games that are played.

SUMMARY

According to one aspect of the present invention there is provided a queuing system for a game apparatus having a game ending condition, comprising:

game end sensor means for generating a game end signal in response to detection of the game ending condition;

data entry and recording means for receiving player identification data identifying each of a plurality of players and recording the player identification data in a sequence;

display means for displaying a single player identification datum; and player identification data indexing means operatively connected to the data entry and recording means, the display means and the game end sensor means for causing the display means to display the next player identification datum in said sequence in response to a game end signal.

The system may be coin operated so that a player's name can be entered in sequence on a list of names after currency in the appropriate amount has been entered into the apparatus.

For greater security, the queuing system may be arranged to disable the game apparatus at the end of a game until the next player in the sequence enters a security identifier, for example a ticket with a unique bar code printed on it. The tickets may be dispensed when names are entered.

To disable a game such as billiards, all of the balls may be captured in a locked ball collector that is unlocked when the next player up enters the security identifier that he received when entering his name.

According to another aspect of the present invention there is provided, in a game apparatus comprising a playing area, game pieces movable on the playing area, receptacle means for receiving game pieces from the playing area and game piece collecting means for collecting game pieces received by the receptacle, the improvement comprising:

sensor means for detecting the collection by the collecting means of a selected one of the game pieces; and display means for producing a display representing the end of a game in response to the detection by the sensor means of the selected one of the game pieces.

According to this aspect of the invention, the game end condition is the collection of a particular game piece, which may be the last piece to be played, for example the black ball in a snooker game. The end of the game may be signaled by changing the names of the players on a display above the apparatus, for example a billiard table.

According to a further aspect of the present invention there is provided a game apparatus having a playing component with lock means for inhibiting play with the playing component, a control component remote from the playing component for controlling the lock means and communication means for communicating between the playing component and the control component, the communication means comprising radiation transmission means and radiation reception means associated with each unit for communicating between the units.

The communication between the playing component of the apparatus, e.g., a billiard table, and the control component, e.g., a consol where coins and the players names are entered, is by radiation such as infra red radiation rather than through wiring which may be difficult to locate without causing access problems. For example, running wires to a billiard table would require under floor wiring to avoid interfering with access to the table or with footing around the table. In respect of a billiard table, it is preferred that the radiation be directed upwardly from the table towards the ceiling, where it may be received directly by an appropriate receiver or reflected to a receiver. This yields minimum interference with the signal being transmitted. To ensure that a signal is received, the system will repeat the signal until it has been received and acknowledged by a receiving station.

The queuing apparatus may include an appropriate subsystem allowing for tournament play. The players may be paired off and, on completion of a game, the game result may be entered at the remote control unit. This results in the losing player being transferred to a "B" sequence.

BRIEF DESCRIPTION OF THE DRAWINGS

In the accompanying drawings, which illustrate an exemplary embodiment of the present invention.

DETAILED DESCRIPTION

Figure 1:
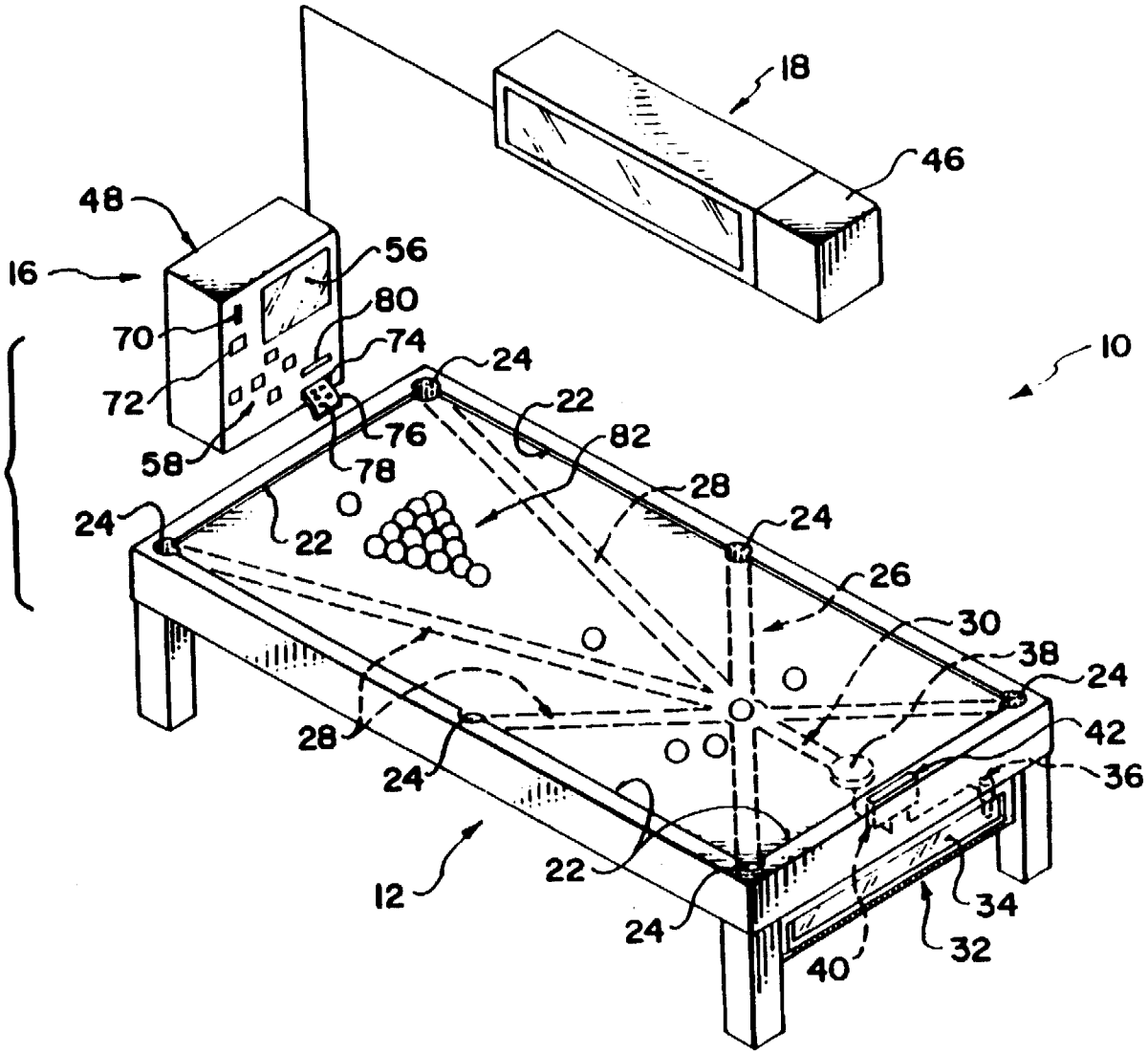
FIG. 1 is a perspective view of one embodiment of the present invention using a billiard table as the game apparatus.
Figure 2:
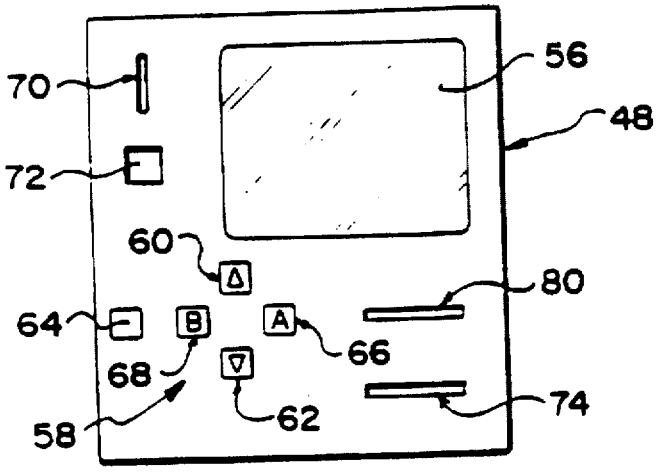
FIG. 2 is a front elevation of a remote consol.

Referring to the accompanying drawings, and especially FIGS. 1 and 2, there is illustrated a game system 10. The system includes a playing component 12 in the form of a billiard table, a wall mounted control component 16 and a ceiling mounted display component 18 above the billiard table.

The billiard table is generally of a conventional sort having a table top 20 surrounded by four cushions 22. Six pockets 24 are found at the corners of the table and midway along the long sides to serve in the usual way as receptacles for billiard balls. Beneath the table top 20 is a ball return system 26 including a series of ball transport troughs 28 leading from the respective pockets 24 to a common ball transport trough 30 leading to a ball collector 32. The collector has a hinged cover 34 that is held closed by a lock 36.

In equipping the table with a queuing system, a sensor 38 is associated with the ball transport trough 30 to detect the passage of a black ball, which is the last ball played in snooker and a number of other games. The sensor is a colour sensitive device that responds only to the passage of the black ball and generates an electric signal that is passed by a wire under the table to a table control device 40 set into one of the end bolsters of the table. The control device monitors different percentages of colour that make up the colour of a ball passing the sensor in order to determine if the sensor ball is the 8 (black) ball. The table control includes an infra red radiation transceiver 42. The transceiver transmits and radiation to and receives radiation from a transceiver 46 on the ceiling mounted display 18. The transceiver 46 is wired to the wall mounted consol 48. The transceivers are known devices, commercially available and require no further description.

The table control is based on a low power computed powered, like all other table-mounted electronics, by a gel cell battery 44 mounted in the table. The table electronics are inactive until energized by an appropriate infrared signal to the transceiver 42.

The wall mounted consol 48 includes a CRT display 56 for displaying at least a segment of the sequence or list of players scheduled to play on the associated billiard table 14. Below the display 56 is a five key keypad 58. The keys include an alphabetic up key 60, an alphabetic down key 62 and an enter key 64. The two remaining keys are a tournament "A" key 66 and a tournament "B" key 68. These are used for selecting one of the two sets of players involved in a tournament.

The consol is also equipped with a coin receiver 70 with the usual coin verifying mechanism and coin return 72. The coin receiver acts to enable the keypad 58 to receive player identification data in the form of player names.

The consol also contains a ticket dispenser or "spiller" 74 for dispensing tickets 76 each marked with a unique set of punched holes 78. The punched holes serve as an identifier code identifying the player identification datum most recently entered. A ticket reader 80 includes a scanner for scanning the punched holes 78 and verifying the correspondence between the code and the player identification datum.

The game apparatus is completed with a set of balls 82 and the usual cues and auxiliary equipment.

Figure 3:
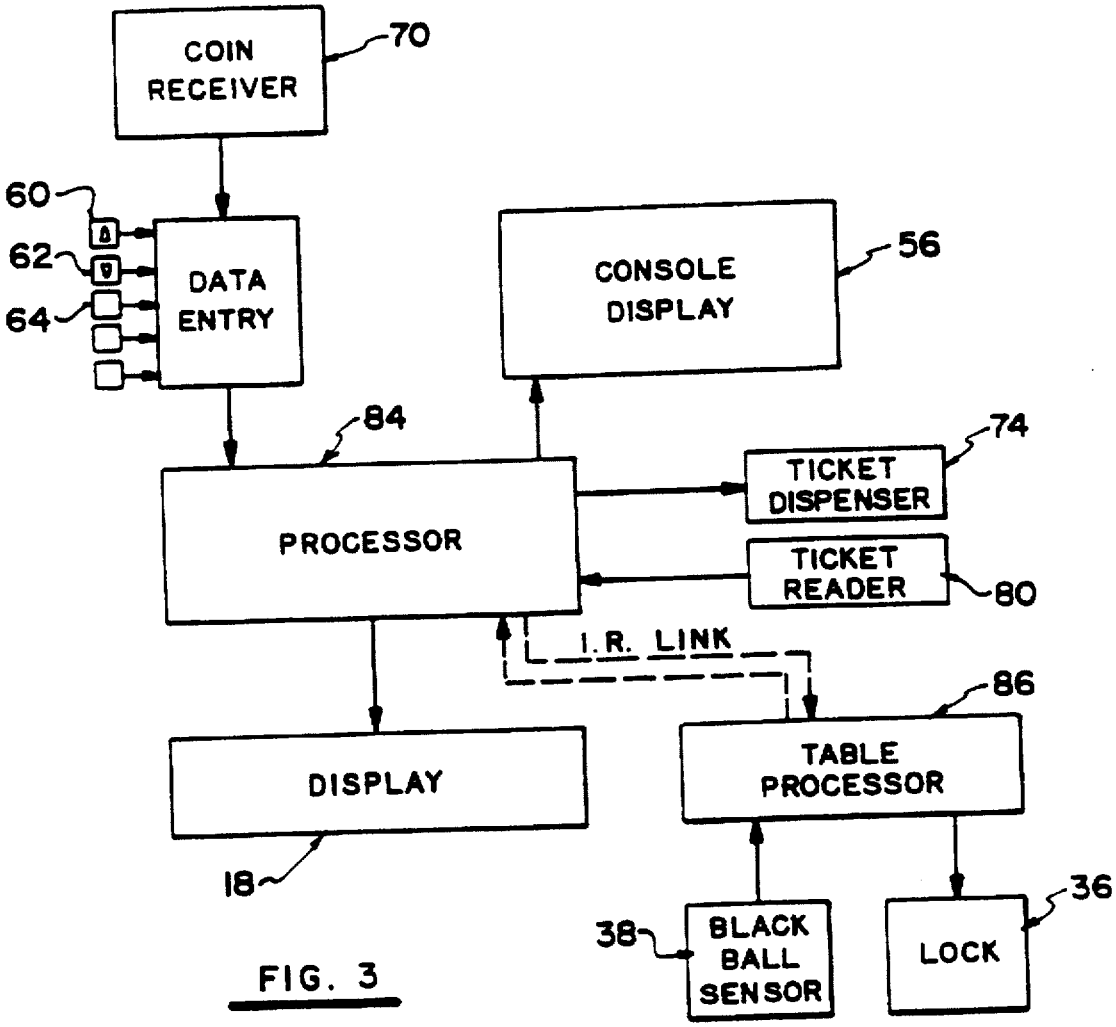
FIG. 3 is a schematic of the queuing system.

The interrelation amongst the various components of the apparatus is illustrated most particularly in FIG. 3. The coin receiver 70 enables the keypad 58 which produces a new line on the CRT display. This display is a twelve line display with twenty-four characters per line. The enabling of the keypad allows entry of information at the last line. The player can select a letter to be placed in the first character position of the line using the alphabet up and down keys 60 and 62. When the correct character appears, the enter key 64 will save that character. The next letter can be entered in the same way and ultimately the complete name can be saved into the memory of a processor 84 using the entry key 64. On saving the name, the processor causes the ticket printer and dispenser 74 to print a unique bar code on the ticket 76 and dispense the ticket for retention by the player.

During play, the processor activates the display 18 to show the name or names of the player or players to whom the table is for the moment assigned. The names of waiting players and their positions in the list of players are displayed in a repeating sequence as play progresses. The processor 84 is in communication with the processor 86 associated with the table. When the black ball sensor 38 detects the black ball in the ball return, it signals the table processor 86 which in turn transmits an infra red signal to the processor 84. This signal continues to be transmitted until the processor 84 returns a verification signal verifying receipt of the signal from the table processor. Upon receipt of the table processor signal the processor 84 indexes the display 18 to show the first in line name or names in the sequence of names recorded in the consol memory. When an appropriate ticket beating a bar code corresponding to the newly displayed player identification data is entered in the ticket reader 80, the processor communicates to the table processor 86 a signal causing the lock 36 to disengage, opening the cover 34 of the ball collector 32. The balls may then be withdrawn and a game played in the usual way until the sensor 38 detects the black ball in the ball return.

Figure 4:
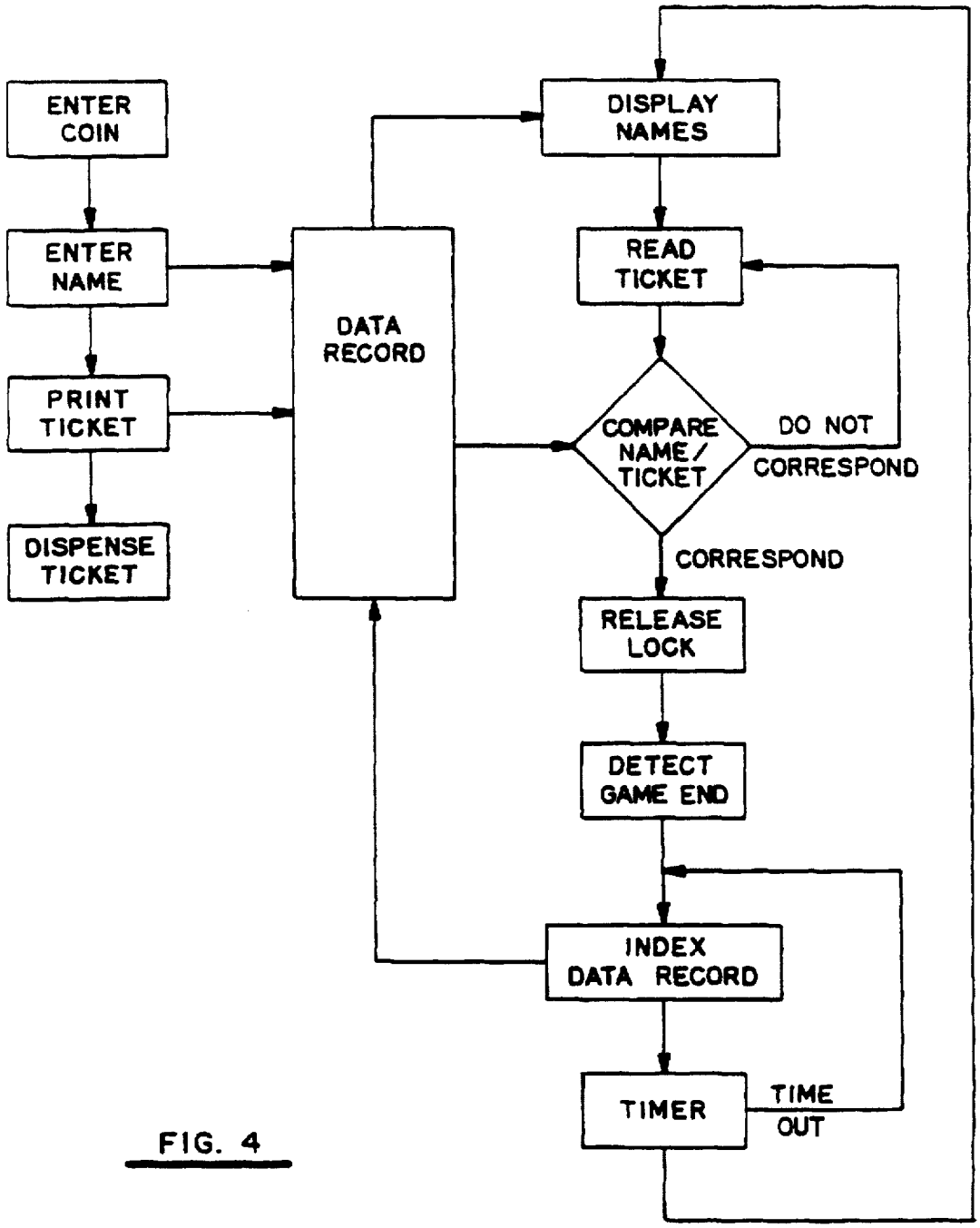
FIG. 4 is a flow chart illustrating the operation of the queuing system.

FIG. 4 is a flow chart depicting the sequence of operations in normal use of the apparatus. Initially, a coin is entered into the consol, a player's name is entered and recorded in the last position in a sequence of names. A ticket is printed using a unique identifier corresponding to the player name entry and the ticket is dispensed to the player. In the meantime, the apparatus displays the first name or names in the sequence of names recorded by the apparatus. When the ticket representing the displayed datum is entered in the ticket meter, the ball collector is opened to release the balls. Play may then proceed until the black ball is detected in the ball return. This causes the apparatus to index the sequence of names so the next name or names appearing in the sequence appear on the display. The ball collector is at this time locked and will not unlock until the correct ticket has been read.

If desired, a countdown timer can be added to the system, with the time initiated by the indexing of the name sequence. If the timer times out without the correct ticket having been entered into the ticket scanner, the system will index the name sequence once more and call for the next player or players in the sequence.

Figure 5:
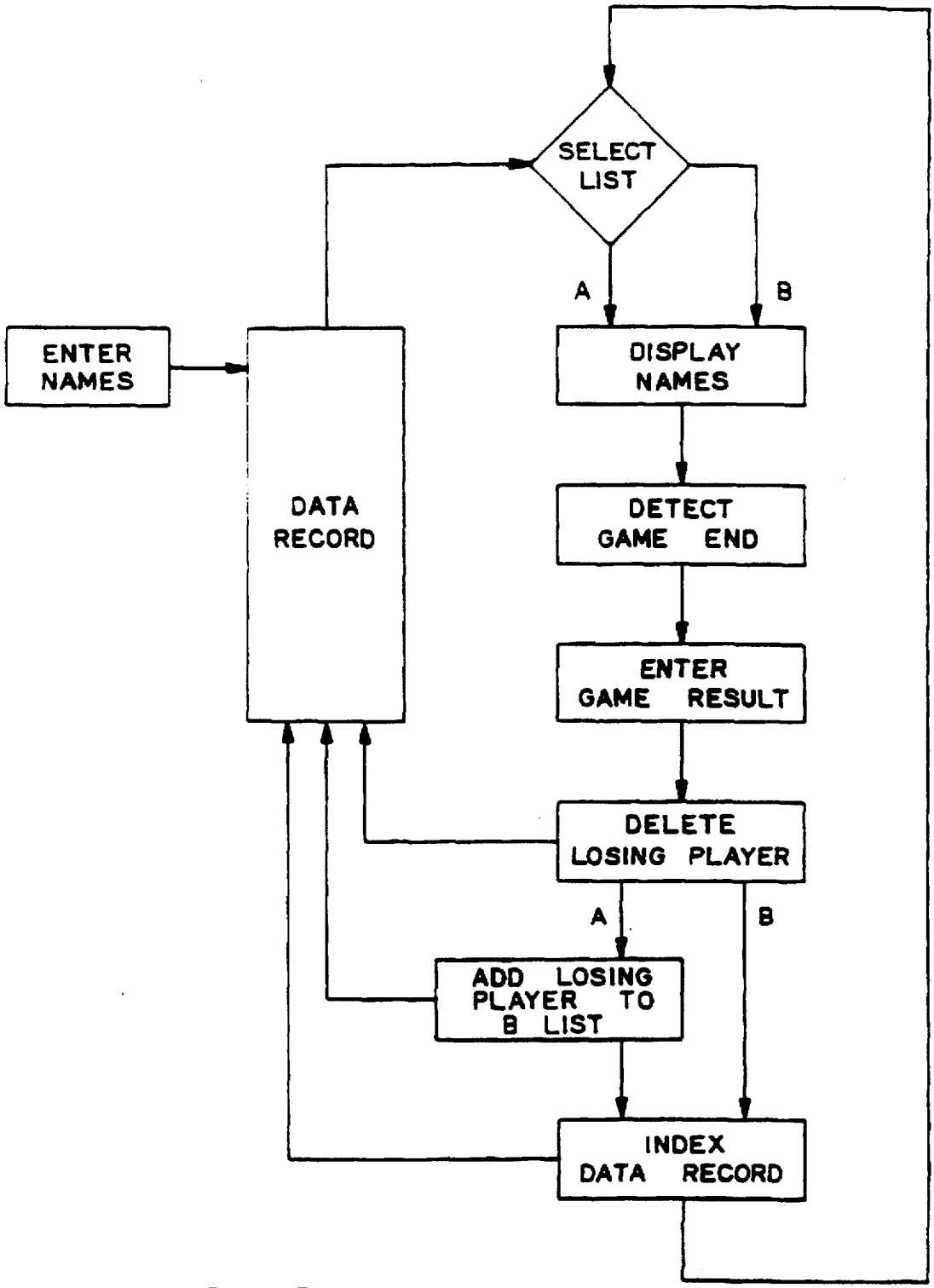
FIG. 5 is a flow chart showing the operation of the queuing system in a tournament mode.

In the tournament mode of play, the operation sequence is similar but no tickets are dispensed and the name sequence is indexed by pressing either tournament "A" key 66 or tournament "B" key 68. Following the play of a game, the key 60, 62 and 64 are used to identify the winner of a particular game. The loser is automatically transferred to a second sequence of names (the "B" list) for the tournament. The sequence of events is summarized in the flow chart in FIG. 5.

While one embodiment of the present invention has been described in the foregoing, it is to be understood that other embodiments are possible within the scope of the invention. It is to be understood that the invention is to be construed as limited solely by the scope of the appended claims.

I claim:

1. A queuing system for a game apparatus having a game ending condition, comprising:

game end sensor means for generating a game end signal in response to detection of the game ending condition;

data entry and recording means for:

receiving player identification data identifying each of a plurality of players;

recording the player identification data in a sequence, recording a player identifier upon recording each player identification datum;

means for recording each identifier on a record medium;

record medium delivery means for delivering the record medium from the system;

display means for displaying a single player identification datum; and player identification data indexing means operatively connected to the data entry and recording means, the display means and the game end sensor means for causing the display means display the next player identification datum in said sequence in response to a game end signal; and identifier record medium reader means for reading the record media and determining whether the identifier carried thereby corresponds to a player identification datum displayed by the display means and game apparatus enabling and disabling means for normally disabling the game apparatus and responsive to a determination by the identifier record medium reader means that the identifier carried by a record medium corresponds to the display player identification datum for enabling the game apparatus.

2. A system according to claim 1 wherein each identifier record medium comprises a card.

3. A system according to claim 1 further comprising selectively actuable tournament play means, including:

player pairing means for selecting from the sequence the player identification data representing two players;

result entry means for receiving game result data identifying at least one of the winning and losing players in a game; and transfer means responsive to receipt of the game result data by the result entry means for removing the player identification datum of the losing player from the sequence before actuation of the indexing means.

4. A system according to claim 3 wherein the sequence is a first sequence and further comprising:

consolation recording means for recording the player identification data of losing players in a second sequence;

second player pairing means comprising means for selecting from the second sequence the player identification data representing two players; and second knock-out means responsive to receipt by the result entry means of game result data from a game between players having player identification data recorded in the second sequence for removing the player identification data of the losing player from the second sequence.

5. A game apparatus comprising:

a playing area;

game pieces movable on the playing area;

receptacle means for receiving game pieces from the playing area;

game piece collecting means for collecting game pieces received by the receptacle and including a game piece collector return means for returning game pieces from the receptacle means to the game piece collector, the game piece collector having a closure and lock means for the closure;

sensor means for detecting the collection by the collecting means of a selected one of the game pieces;

display means for producing a display representing the end of a game in response to the detection by the sensor means of the selected one of the game pieces; and queuing means, including recording means for recording the sequence of authorized players and a player identifier datum for identifying each player in the sequence, identifier receiving means for receiving identifier data from a player and lock releasing means for releasing the closure lock means upon receipt of identifier data identifying the first player in the sequence.

6. Apparatus according to claim 5 including index means for indexing the queuing means to the next player in the sequence in response to the sensor means detecting the selected one of the game pieces.

7. Apparatus according to claim 5 wherein the receptacle means comprise plural receptacles.

8. Apparatus according to claim 7 wherein the game apparatus comprises a billiards table and the game pieces comprise a set of balls.

9. Apparatus according to claim 8 wherein the sensor means comprise a black ball detector.

10. Apparatus according to claim 8 wherein the collector means comprises a closure and lock means for the closure.

11. A billiard table system comprising a table having a ball return, table control means including lock means for locking the ball return, remote control means remote from the table and including means for unlocking the lock means and communication means communicating between the table control means and the remote control means, the communication means comprising a table radiation source mounted on the table to radiate upwardly, a table radiation receiver mounted on the table adjacent the source to receive radiation from above, a radiation source and a radiation receiver coupled to the remote control means for delivering radiation to and receiving radiation from the table radiation receiver and source respectively.

* * * * *